United States Patent [19]

Green

[11] Patent Number: 5,075,914

[45] Date of Patent: Dec. 31, 1991

[54] FOOT-OPERATED TIRE CHANGING ASSEMBLY

[76] Inventor: Beatrice Green, 1346 Ventura Dr., Lakewood, N.J. 09701

[21] Appl. No.: 548,542

[22] Filed: Jul. 5, 1990

[51] Int. Cl.[5] ..... B25F 3/00

[52] U.S. Cl. ..... 7/100; 7/138; 7/170; 81/52; 81/488

[58] Field of Search ..... 7/100, 138, 170; 254/1; 81/488, 52, 54, 57.42, 57.43, 57.46, 180.1

[56] References Cited

U.S. PATENT DOCUMENTS 4,833,746 5/1989 Yong ..... 7/100

4,872,230 10/1989 Levine ..... 7/100

*Primary Examiner*—Roscoe V. Parker

*Attorney, Agent, or Firm*—Terry M. Gernstein

[57] ABSTRACT

A tire changing assembly includes a foot pedal mechanism connected to a connection assembly that includes a coupling for a vehicle jacking device or to a lug nut device. The foot pedal assembly is operated by stepping onto a foot-engaging element and releasing that element after applying forcing that element down. An operator uses his or her weight to force the pedal down and a spring returns the pedal to a raised orientation. The pedal movement is translated into rotational movement or into reciprocating linear movement so a lug wrench or a jack device can be operated.

14 Claims, 7 Drawing Sheets

FIG. 5
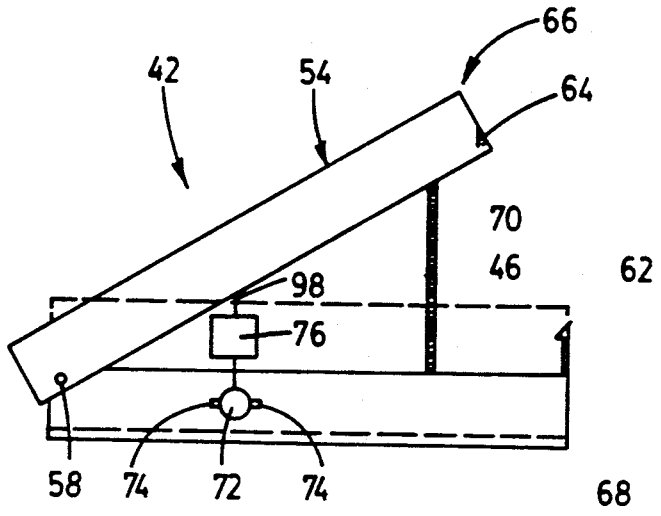
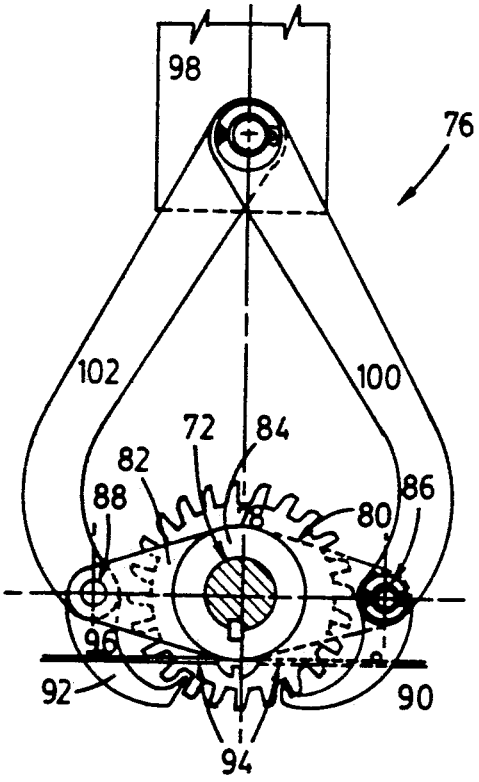
FIG. 6
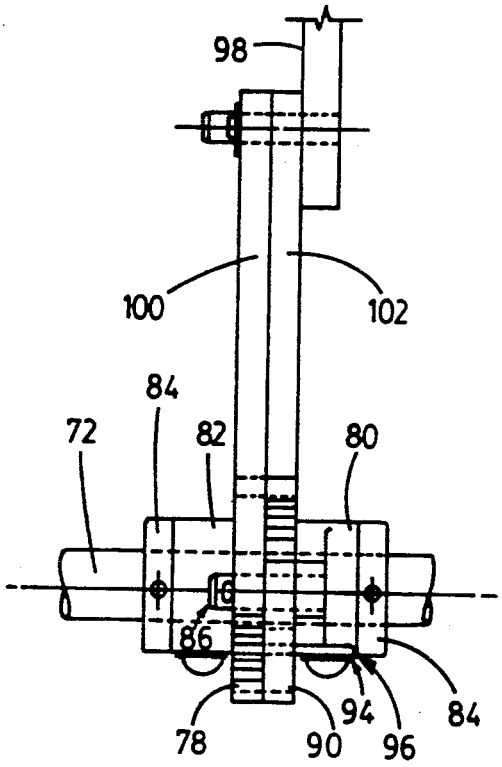
FIG. 7

FOOT-OPERATED TIRE CHANGING ASSEMBLY

TECHNICAL FIELD OF THE INVENTION

The present invention relates to the general art of land vehicles, and to the particular field of tools for use in conjunction with land vehicle tires.

BACKGROUND OF THE INVENTION

One of the more aggravating aspects of operating a land vehicle is associated with changing a tire on that vehicle that has gone flat. This process often involves removing a hub cap, loosening lug nuts, elevating the vehicle, removing the loosened lug nuts, removing the flat tire from the axle, and replacing it with another tire. The process also requires the operator to reverse the just-described process after the new tire is in place.

Loosening and tightening lug nuts generally involves applying a lug wrench to the lug nuts and rotating such lug wrench, and elevating and lowering the vehicle generally involves operating a vehicle jacking device. Both of these tools generally require some application of force thereto, with such force generally being generated from a user's arms, shoulders and back.

Changing a tire is usually an arduous task at best, but can be particularly onerous for a handicapped or elderly person or another individual who is unable to apply sufficient force to efficiently operate the lug wrench or the vehicle lifting jack.

The lug nuts are often so tightly mounted on the flat tire that such an individual cannot loosen them sufficiently to complete the tire changing operation. Furthermore, even if the vehicle jacking device has a significant mechanical advantage, such individuals often simply do not have sufficient strength to properly operate the jacking device.

While the art has included designs for hydraulic systems on a vehicle to lift that vehicle for service, such systems are often expensive, complicated and difficult to maintain. Even then, such systems do not assist in the removal of lug nuts.

While the art also includes several designs for automatic lug wrenches, such devices are generally not carried in a vehicle and are only found in service stations.

Accordingly, there is a need for an assembly which can be used by an individual to assist in manipulating the lug wrench and the vehicle jacking device so changing a flat tire can be carried out by an individual who may lack sufficient strength to operate a lug wrench or vehicle jacking device in an unaided manner, yet is simple in design and small in size so it can be easily carried in the vehicle.

OBJECTS OF THE INVENTION

It is a main object of the present invention is to provide an assembly which can be used by an individual to assist in manipulating the lug wrench and the vehicle jacking device.

It is another object of the present invention to provide an assembly which can be used by an individual to assist in manipulating the lug wrench and the vehicle jacking device so changing a flat tire can be carried out by an individual who may lack sufficient strength to operate a lug wrench or vehicle jacking device in an unaided manner.

It is another object of the present invention to provide an assembly which can be used by an individual to assist in manipulating the lug wrench and the vehicle jacking device so changing a flat tire can be carried out by an individual who may lack sufficient strength to operate a lug wrench or vehicle jacking device in an unaided manner, yet is simple in design.

It is another object of the present invention to provide an assembly which can be used by an individual to assist in manipulating the lug wrench and the vehicle jacking device so changing a flat tire can be carried out by an individual who may lack sufficient strength to operate a lug wrench or vehicle jacking device in an unaided manner, yet is simple in design and small in size so it can be easily carried in the vehicle.

SUMMARY OF THE INVENTION

These, and other, objects are achieved by a foot-operated assembly which permits a user to employ his or her weight to assist them in removing lug nuts from a land vehicle wheel and/or for operating a vehicle lifting jack. The assembly is operated when the user steps down onto it and translates the movement into rotational movement and/or reciprocating linear movement. The rotational movement is used to operate either a rotational vehicle jacking device or to loosen or tighten a lug nut, and the reciprocating linear movement is used to operate a rack and lever type vehicle lifting jack.

BRIEF DESCRIPTION OF THE DRAWING FIGURES

FIG. 5 illustrates the major components of the foot pedal portion of the overall assembly.

FIG. 6 is a side elevational view of the foot pedal assembly mechanism which translates reciprocating linear movement of the foot pedal assembly into rotational motion of a shaft.

FIG. 7 is a top plan view of the mechanism shown in FIG. 6.

DETAILED DESCRIPTION OF THE PREFERRED EMBODIMENT OF THE INVENTION

Figure 1:
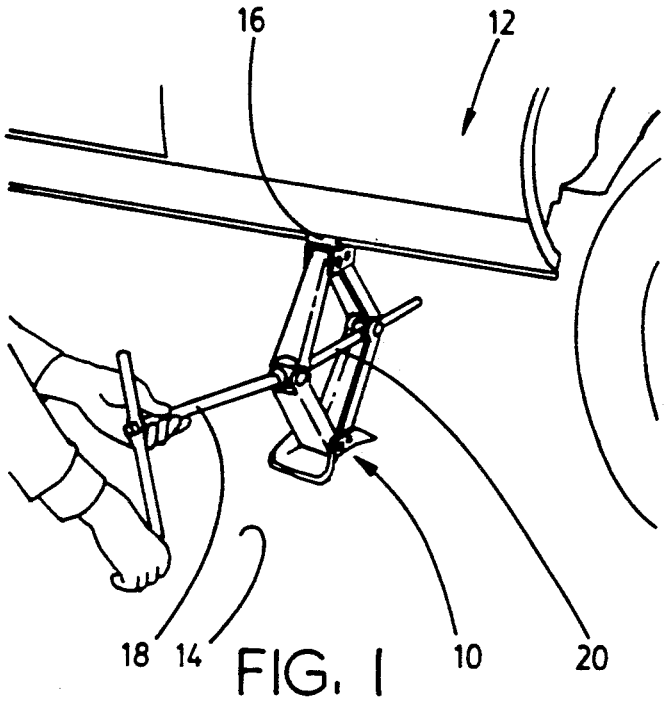
FIG. 1 is a perspective view of a rotational-type vehicle lifting jack in position to lift a land vehicle.

Shown in FIG. 1 is a rotational-type land vehicle lifting jack 10 in position beneath a land vehicle 12. The jack 10 rests on a suitable support surface 14 beneath the vehicle and includes a vehicle-engaging top portion 16 which engages the vehicle at suitable location. The jack is operated by engaging a handle 18 with a screw portion 20 of the jack, and rotating the handle one way to elevate the vehicle, and the opposite way to lower that vehicle.

Figure 2:
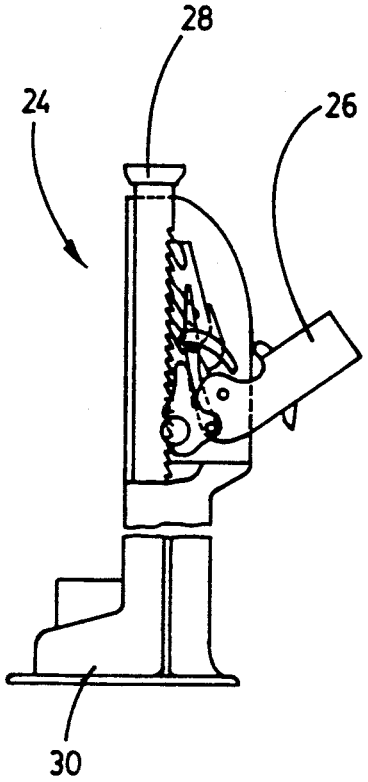
FIG. 2 is a side elevational view of a rack and lever type vehicle lifting jack.

A rack and lever type vehicle lifting device 24 is shown in FIG. 2 and includes a lever operated portion 26 that is reciprocated up and down to elevate or lower the vehicle after top portion 28 is engaged with the vehicle and bottom foot 30 thereof is properly seated on a support surface beneath the vehicle.

As was discussed above, operation of either of these two lifting devices may require more strength than some users possess. Furthermore, the torque required to loosen or properly tighten lug nuts on the vehicle wheels may require more strength than some users possess. Accordingly, the present invention is embodied in an overall assembly 40, illustrated in FIG. 3, which permits a user to utilize his or her weight to operate the vehicle lifting jack or a lug wrench.

The overall assembly 40 includes a foot-operated pedal assembly 42 which is placed adjacent to the lug vehicle in a position suitable for operating either a jack 10 or a jack 24 or a lug wrench and upon which a user simply steps to operate the jack or the lug wrench. The foot-operated pedal assembly 42 has two elements which reciprocate as the user applies his weight to the assembly 42 and releases his weight from that assembly 42. The assembly 42 is connected to a connection assembly 44 which translates the reciprocating motion of the foot pedal assembly into either rotational motion which can be used to operate the jack 10 or a lug wrench, or further reciprocating linear motion which can be used to operate the jack 24.

Figure 4:
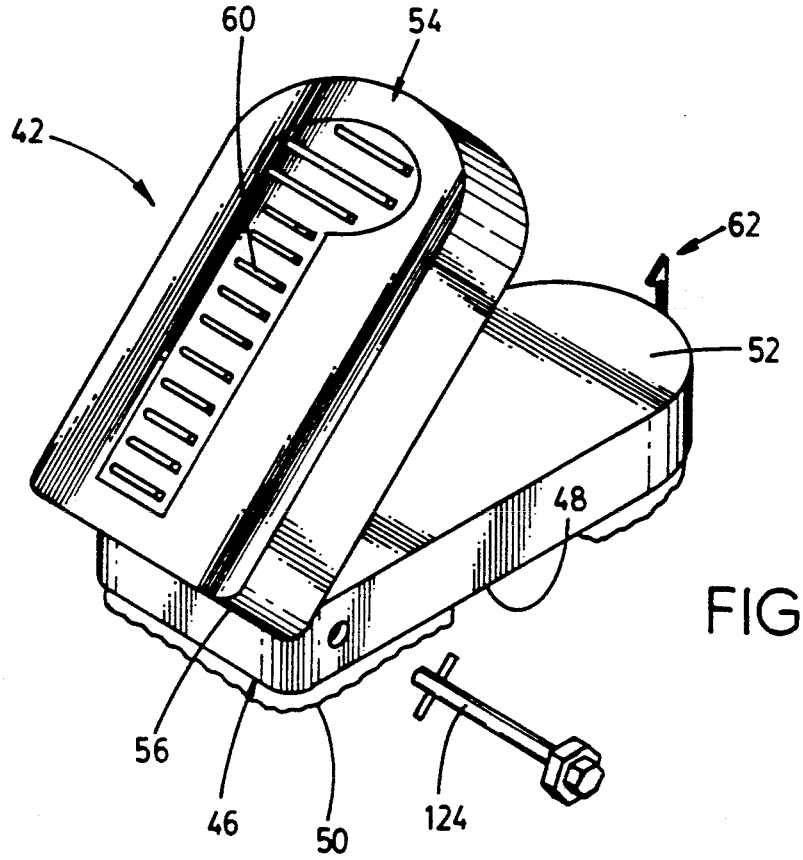
FIG. 4 is a perspective view of the foot pedal portion of the overall assembly.

The foot-operated pedal assembly 42 is more specifically shown in FIGS. 4–7, and attention is directed thereto. As shown in FIGS. 4 and 5, the assembly 42 includes a base 46 which rests on a suitable support or raising surface to be located adjacent to the jack or to the wheel lugs of interest. The base includes a bottom surface 48 which has non-skid means 50 thereon, and a top surface 52, and is in the shape of a footprint in the preferred embodiment.

A foot-engaging element 54 is pivotably attached at a proximal end 56 thereof by a pivot pin 58 and has non-skid elements 60 on a top surface thereof. The element 54 is also in the shape of a footprint and is sized to slide over the base when the element 54 is pressed down all the way against that base. A suitable lock is mounted on the assembly 42 to lock the element 54 to the base 52. The assembly 42 is stored in the locked condition. The preferred form of the lock includes a pawl 62 on the base and a notch 64 defined in the element 54, with the pawl engaging the notch to hold the distal end 66 of the element 54 against the rear end 68 of the base.

The element 54 is adapted to pivot about the pivot pin 58 from the FIG. 5 ready position to a horizontal position with the element 54 lying on top of the base as indicated in phantom lines in FIG. 5. The user steps on top of the element 54 to drive it into the phantom line position from the FIG. 5 ready position.

This downward movement of the element 54 is resisted by a compression spring 70 that is connected at one end thereof to the element 54 and at the other end thereof to the base 46 and which biases the element 54 upwardly toward the FIG. 5 ready position and against the force exerted by the user's weight. Thus, when the user steps off of the element 54, the spring 70 will return the element 54 from the phantom line position shown in FIG. 5 to the full line position thereof as shown in FIG. 5. The element 54 thus undergoes reciprocating movement about the pivot pin 58.

This user weight-actuated reciprocating movement of the element 54 is translated by the device of the present invention into either rotational movement or further linear reciprocating movement. To this end, the assembly 42 includes a shaft 72 mounted, as by bearings or the like, on the base element 46 to extend transversely thereof. The shaft 72 is hollow and has keyways 74 thereon for a purpose that will be understood from the ensuring discussion.

The shaft 72 has a longitudinal centerline and is mounted to rotate about such centerline. The assembly 42 includes a mechanism 76 which converts the reciprocating movement of the element 54 with respect to the base 46 into continuous rotary motion of the shaft 72.

This mechanism is shown broadly in FIG. 5, and more specifically in FIGS. 6 and 7. The mechanism 76 includes a ratchet 78 keyed to the shaft 72. On each side of the ratchet and turning freely on the shaft are pawl arms 80 and 82. These arms are held in place by collars 84 which are pinned to shaft 72. At the outer ends of arms 80 and 82 are pins 86 and 88, about which pawls 90 and 92 are free to swivel. These pawls are held in contact with the teeth of ratchet 78 by springs 94. The latter are attached to the hubs of the pawl arms and bear against spring pins 96 mounted on pawls 90 and 92.

The reciprocating member 98 is attached at one end thereof to the element 54 and is connected at the other end thereof by links 100 and 102 to the outer ends of the pawl arms 86 and 88. One link is on one side of ratchet 78 and the other link is on the other side of the ratchet.

As reciprocating member 98 moves upwards, the ratchet is rotated counter-clockwise by the pawl 92 engaging a ratchet tooth. During this movement, pawl 90 rides over the ratchet teeth. When member 98 moves downwardly toward the base 46, pawl 90 engages a ratchet tooth and continues the rotation of both the ratchet and shaft 72 in a counter-clockwise direction. During this movement, pawl 82 slips over the ratchet teeth.

The pawls are beveled at their outer ends on the side adjacent to each other, as shown by pawl 90 in the plan view, so that the two pawls can pass over each other without interference when they are at the extreme downwardmost end of their travel. Likewise, links 100 and 102 are curved, so that they will readily clear ratchet 78 when member 98 is at the extreme downwardmost end of its movement.

Figure 3:
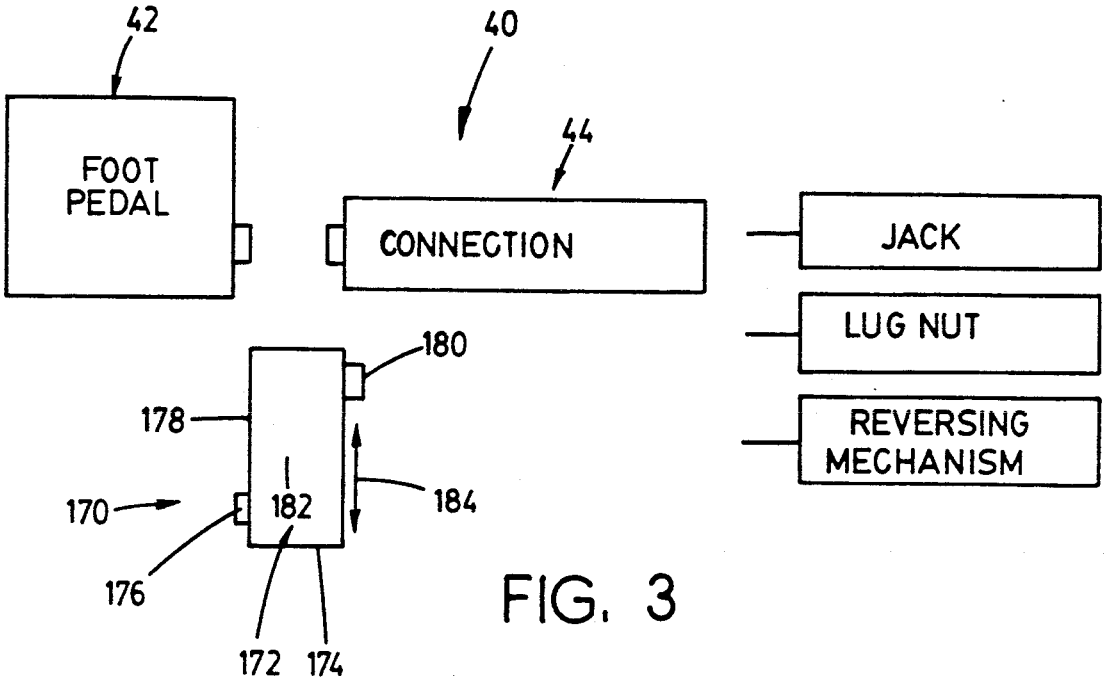
FIG. 3 is a block diagram of an assembly embodying the present invention.
Figure 9:
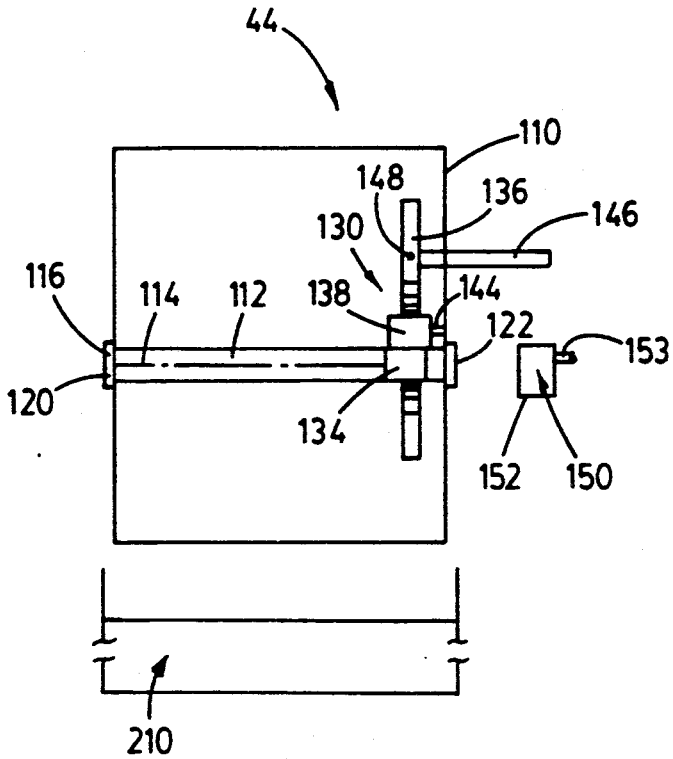
FIG. 9 illustrates a connection portion of the overall assembly.

The rotation of the shaft 72 is transferred to the connection assembly 44. The connection assembly 44 is best shown in FIGS. 3 and 9 and attention is directed thereto. As shown in FIG. 9, the connection assembly includes a hollow housing 110 and has a shaft 112 mounted therein for rotation about its longitudinal axis 114. The shaft 112 is coupled to the shaft 72 by a first coupling element 116. The preferred form of the first coupling element 116 includes keys 120 that engage in the keyways 74 of the shaft 72 so that rotation of the shaft 72 is imparted to the shaft 112 to cause that shaft 112 to rotate about the longitudinal axis 114 thereof. A second coupling element 122 is mounted on the shaft 112 on the end thereof opposite to the first coupling element 116. The second coupling element also is hollow and includes suitable keyways in the nature of the keyways 74.

Rotation of the shaft 112 can be applied directly to a lug or to a jack 10 via the second coupling 122 by attaching the screw 20 to the shaft via that coupling 122. Alternatively, a coupling element 124 shown in FIG. 4 can be used to couple either of the coupling elements 120 or 122 to an adjacent element.

If the jack 24 is to be operated by the assembly 40, the rotational motion of the shaft 72 must be translated into reciprocating linear motion so that the handle 26 can be operated in a manner to move the jack top 28 up or down.

Therefore, the connection assembly 44 includes a mechanism 130 which obtains uniform reciprocating motion from the rotational motion of the shaft 72. The mechanism 130 is shown in FIGS. 8 and 9 and is connected to the shaft 112 and has the various elements thereof mounted on the wall of the housing.

Figure 8:
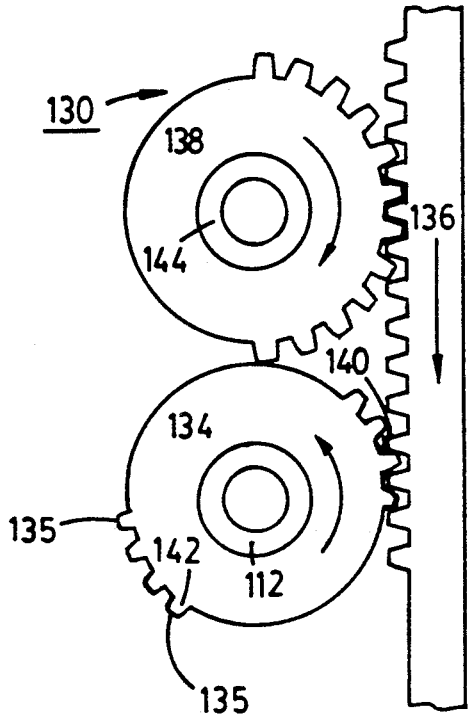
FIG. 8 is a side elevational view of a connection assembly portion of the overall assembly which generates reciprocating linear motion from rotational motion of a shaft.

Referring to FIG. 8, the intermittent driving gear 134 is mounted on the shaft 112 and rotates constantly in the direction indicated by the arrow. The teeth of gear 134 mesh alternately with the teeth of rack 136 and gear 138. In the position shown in FIG. 8, the leading tooth of gear 134 is about to make contact with the first tooth of gear 138, causing the latter to rotate in the direction indicated. The motion of gear 138 is transmitted to the rack 135, causing it to move downwardly.

As the last tooth 140 in gear 134 completes its contact with the mating tooth in gear 138, the tooth 142 in gear 134 is ready to engage the mating tooth in rack 136. When this occurs, the direction of movement of rack 136 is reversed. At this point, the teeth on gear 138 are in the clearance space of the gear 134. Gear 138 is then drive by rack 136 until tooth 142 of gear 134 meshes with gear 138. The alternative driving of rack 136 by gear 134 and gear 138 produces a uniform reciprocating motion of the rack.

The number of teeth in each tooth section of gear 134 is two less than one-quarter of the number of teeth that would be carried by a full gear of the same size and pitch. This prevents clashing and the effect is the same as that produced by a quarter turn of a gear having the full number of teeth. Furthermore, the two end teeth in each toothed section of gear 134 are modified at locations 135 to provide clearance to permit the reversal of rack 136. On large gears, it is desirable to modify the succeeding tooth as well. It is also desirable to remove a small amount of material from the leading face of the leading tooth in each group of teeth in gear 134 to permit a slight lag in the reversal of rack 136. The degree of modification of the teeth necessary for the proper functioning of the mechanism will vary with the size of the gears and their pitch.

The length of travel of rack 136 is determined by the diameters of gears 134 and 138. The number of teeth in these gears is divisible by four. The gear 138 is mounted on a shaft 144 that is rotatably mounted on the housing.

A lever arm 146 is pivotably mounted on one end thereof to the rack 136 by a pivot pin 148 and extends out of the housing 110 via an elongate slot defined through that housing. The other end of the lever arm 146 is engaged in the element 26 of the jack 24. The reciprocating movement of the rack is transferred by the lever arm to the jack to operate that jack. Thus, in the preferred embodiment, the slot in the housing is vertically oriented.

Figure 10:
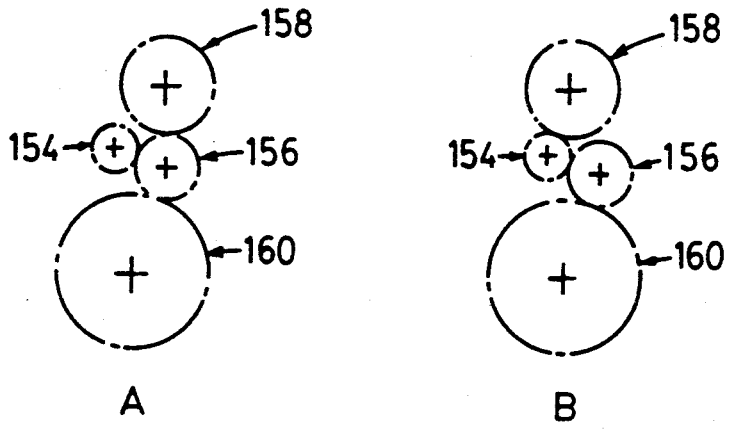
FIGS. 10A and 10B illustrate a mechanism which is attached to the connection portion to reverse the rotational output of the overall assembly.

In the event that the rotary motion of the shaft 112 is to be used to loosen a lug, a reversing mechanism 150 is attached to the shaft second coupling 122. The reversing mechanism 150 is shown in FIGS. 9 and 10 as including a housing 152 in which suitable gears are rotatably mounted. A lever arm 153 is used to control motion of the gears. The mechanism 150 includes two intermediate gears 154 and 156 which are mounted on the swiveling arm 153 and which can be adjusted for engaging either one of the intermediate gears with a spindle gear. When the gears are in the position shown in FIG. 10A, the drive is from gear 158 which is keyed to the shaft 112, through gear 156 to gear 160. When the arm carrying the intermediate gears is shifted as indicated in FIG. 10B, the motion is transmitted through both intermediate gears or from gear 158 through gear 154 and gear 156 to gear 160, thus reversing the direction of rotation. The output of the mechanism is via the gear 160, and it is to this gear 160 that the lug nut to be loosened is connected.

Figure 11:
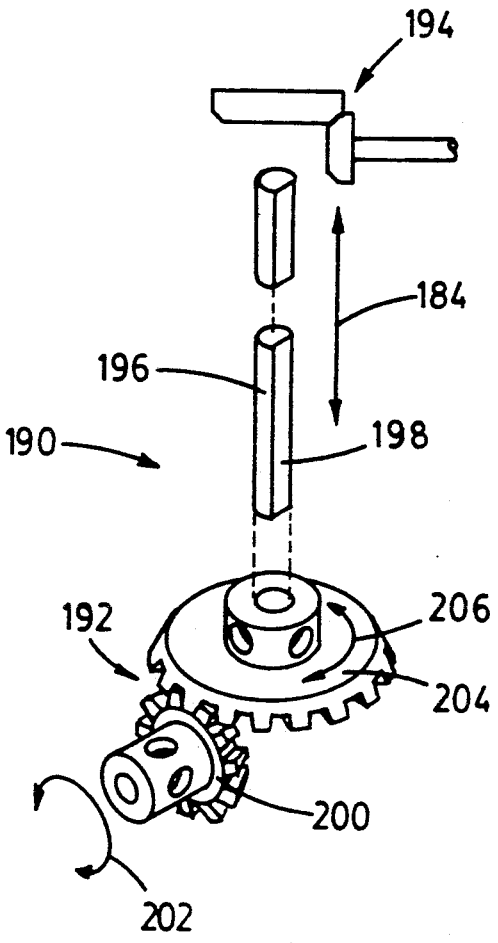
FIG. 11 illustrates a mechanism to transfer rotational from the foot pedal portion to the connection portion of the overall assembly so the connection portion can be elevated above the foot pedal portion of the overall assembly.

If the foot pedal assembly 42 is placed firmly on the ground so it can be safely and easily operated by a user pressing his or her foot thereagainst as above discussed, a situation may occur in which the connection to a tire lug nut or to a handle of a lifting jack must be effected at a level above the foot pedal. In order to accomplish this elevation of the connection, the overall assembly includes a transfer assembly 170 which is best shown in FIGS. 3 and 11. The transfer assembly 170 includes a housing 172 which has a bottom end 174 that rests on the ground adjacent to the foot pedal assembly 42, and has a first coupling element 176 mounted on one end wall 178 thereof. The coupling element 176 is similar to the coupling element 120 and connects to the shaft 72 of the foot pedal assembly 42 to be rotated thereby. The transfer assembly 170 further includes a second coupling element 180 that is located adjacent to a second wall 182 of the housing. The second coupling element 180 extends through an elongate vertically oriented slot in the wall 182 and is movable in a vertical direction as indicated by the double-headed arrow 184. The second coupling is identical to the coupling 120.

Rotation of the shaft 72 is transferred from the coupling 176 to the coupling 180 via a transfer assembly 190, best shown in FIG. 11. The transfer assembly 190 includes a first bevel gear coupling 192 that is coupled to the coupling 176, and a second identical bevel gear coupling 194 connected to the coupling 180. A shaft 196 having a planar portion 198 connects the first and second bevel gear couplings together. The second bevel gear coupling is slidable along the length of the shaft 196 so the elevation of the second bevel gear coupling can be altered with respect to the first bevel gear coupling.

The bevel gear couplings 192 and 194 are identical, so only one of these couplings is shown in FIG. 11. Each coupling includes a first bevel gear 200 that rotates about a horizontal axis as indicated by arrow 202 and which is engaged with a second bevel gear 204 that rotates about a vertical axis as indicated by arrow 206. The first bevel gear is connected to coupling 176 (or 180 for coupling 194) and the second bevel gear is connected to shaft 196. Rotation of the shaft 72 is transferred to bevel gear 200 via the coupling 176, and is then transferred to the shaft 196 via the bevel gear 204. The rotation of shaft 196 is then transferred to the bevel gears of the coupling 194 and to a shaft connected to that coupling in a manner identical to the manner described above with regard to the connection of assembly 44 to the jacks or to a lug wrench. A reversing mechanism such as mechanism 150 can be coupled to the coupling 194 if suitable.

Figure 12:
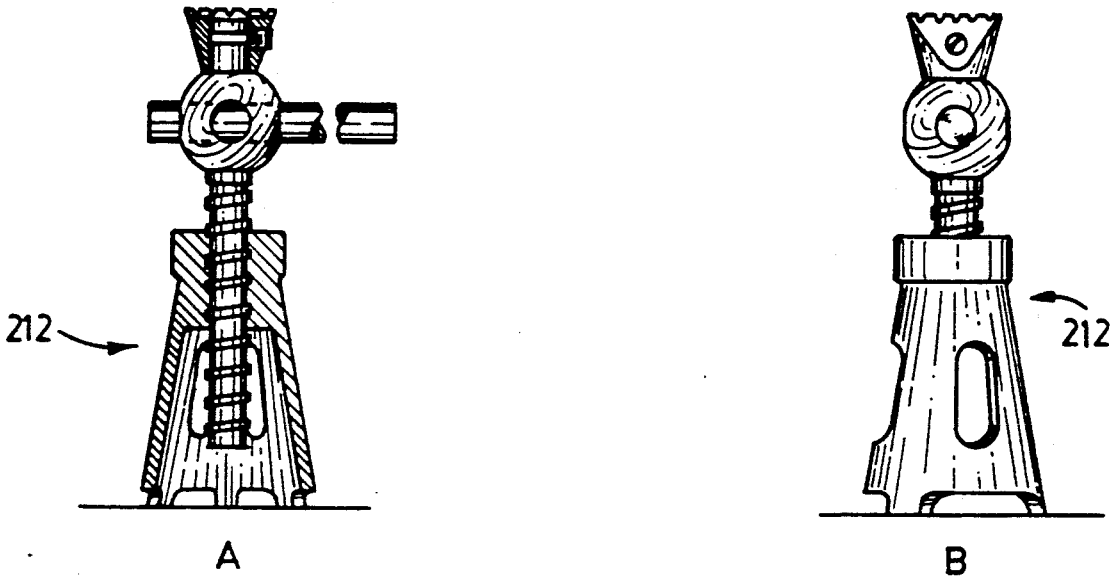
FIGS. 12A and 12B illustrate a jack screw which is used to alter the height of the connection assembly with respect to the foot pedal assembly.

As shown in FIG. 9, the connection assembly 44 is mounted on an elevatable device 210 which includes jack screws, such as jack screw 212 shown in FIGS. 12A and 12B. Using the jack screw, the mechanism 44 can be elevated to a desired height above the ground so a lug wrench or a jacking device connected thereto as above discussed, will be at the proper height for operation.

Figure 13:
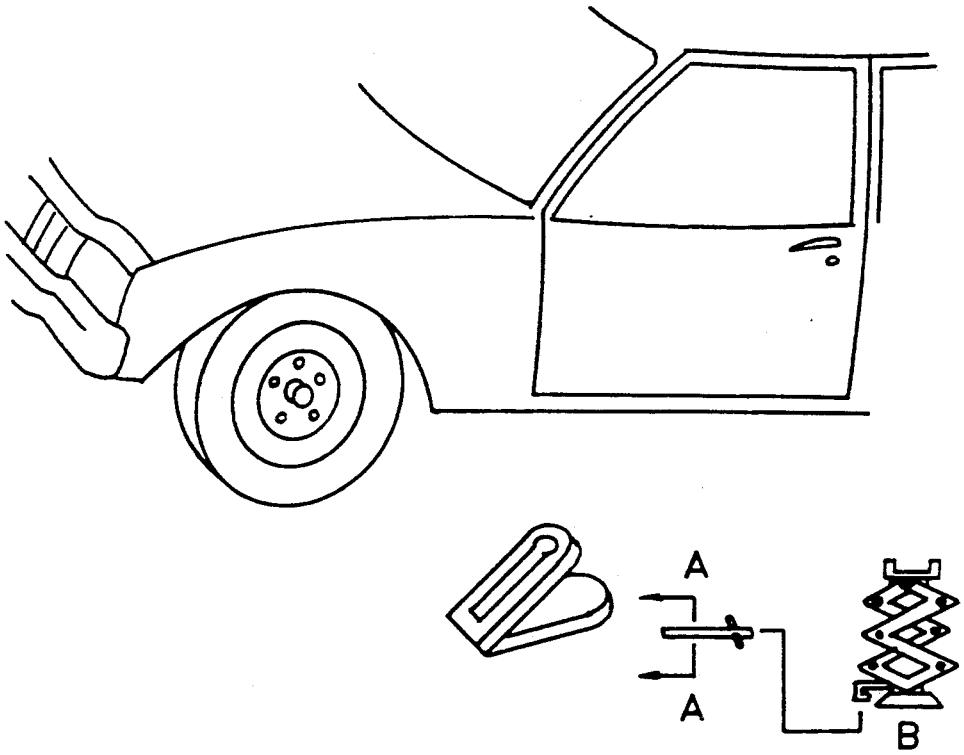
FIGS. 13-15 illustrate on alternative form of the invention.
Figure 14:
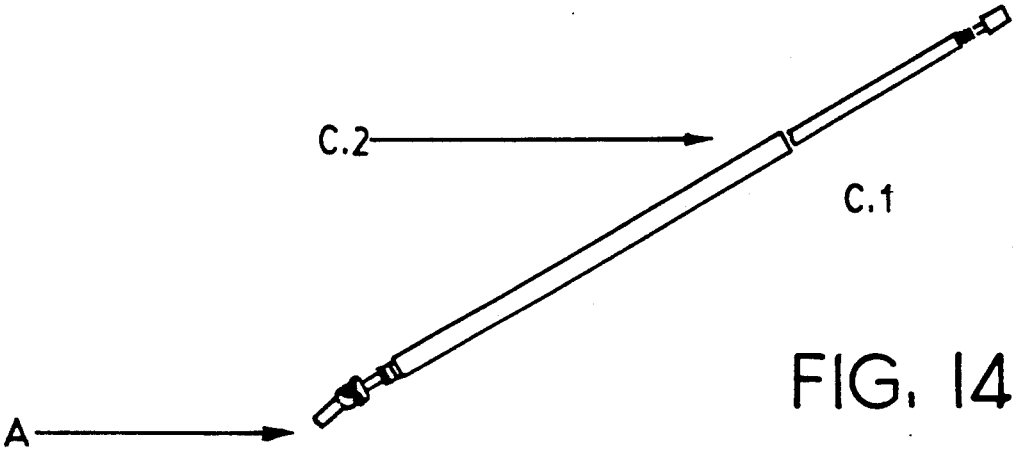
Figure 15:
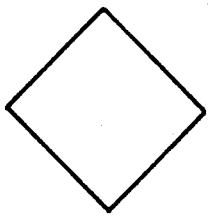

An alternative form of the invention is shown in FIGS. 13 to 15 in which a nut-like opening on the pedal appears on both sides thereof. As part C fits onto a car lug nut and into the foot pedal opening which is shaped as shown in FIG. 15. A part C1 fits over the wheel nuts and turns those nuts while the pedal is operated. A part C2 is an extension to allow reach. Otherwise, part A fits onto the pedal at C.

It is understood that while certain forms of the present invention have been illustrated and described herein, it is not to be limited to the specific forms or arrangements of parts described and shown.

I claim:

1. A foot-operated tire changing mechanism comprising:

A) a foot pedal assembly which includes
- (1) a base,
- (2) a foot-engaging element,
- (3) a pivot element pivotably connecting said foot-engaging element to said base,
- (4) a compression spring connected at one end thereof to said base and at another end thereof to said foot-engaging element and biasing said foot-engaging element away from said base,
- (5) said foot-engaging element pivoting about said pivot element and moving against said compression spring bias towards said base under influence of a user's foot and pivoting about said pivot means and moving under the influence of said compression spring bias away from said base,
- (6) a shaft rotatably mounted on said base, said shaft having a longitudinal axis, and
- (7) a mechanism connecting said shaft to said foot-engaging element and rotating said shaft about said shaft longitudinal axis as said foot-engaging element moves toward and away from said base; and B) a connection assembly which includes
- (1) a housing,
- (2) a shaft having a longitudinal axis and being mounted on said connection assembly housing to rotate about said connection assembly shaft longitudinal axis,
- (3) a first coupling element connected to said connection assembly shaft for coupling said connection assembly shaft to said foot pedal assembly shaft and transferring rotational motion of said foot pedal assembly shaft to said connection assembly shaft,
- (4) a second coupling element on said connection assembly shaft,
- (5) a jack mechanism connection assembly which includes
  - (a) an elongate slot defined through said connection assembly housing,
  - (b) a lever arm extending through said slot and being connected to said connection assembly housing adjacent to said slot for reciprocating movement in said slot, and
  - (c) a mechanism connecting said lever arm to said connection assembly shaft and reciprocating said lever arm as said connection assembly shaft rotates, and
- (6) a lug wrench connection assembly which includes
  - (a) a coupling element on said connection assembly shaft for coupling said connection assembly shaft to a lug wrench.

2. The foot-operated tire changing mechanism defined in claim 1 further including an elevating assembly connected to said connection assembly.

3. The foot-operated tire changing mechanism defined in claim 2 wherein said foot pedal assembly includes a ratchet keyed to said foot pedal assembly shaft, pawl arms on each side of said ratchet and being mounted to turn freely on said foot pedal assembly shaft, collars pinned to said foot pedal assembly shaft and connected to said pawl arms, pins on each of said pawl arms, a pawl connected to each pawl arm by a pin on said pawl arm, springs holding each pawl in contact with teeth on said ratchet, said springs being attached to hubs on said pawl arms and to said pawls, a connection means on said foot pedal assembly shaft, links connected at one end thereof to said connection means and at the other end thereof to said pawl arms, said pawls being beveled to ride over said ratchet teeth when said foot pedal assembly shaft rotates in one direction, and to engage said ratchet teeth when said foot pedal assembly rotates in an opposite direction.

4. The foot-operated tire changing mechanism defined in claim 3 wherein said connection assembly includes a first gear mounted on said connection assembly shaft for rotation therewith, a rack mounted on said connection assembly housing for reciprocating movement, said rack including gear teeth, a second gear engaged with said rack gear teeth, said first and second gears having teeth on only a portion of the periphery thereof to alternatively engage said rack gear teeth and each other.

5. The foot-operated tire changing mechanism defined in claim 4 wherein the number of teeth on each tooth section of said connection assembly first gear is two less than one-quarter of the number of teeth that would be carried by a full gear of the same size and pitch.

6. The foot-operated tire changing mechanism defined in claim 5 wherein the two end teeth in each toothed section of said connection assembly first gear are modified to be different in outer peripheral shape from the remaining teeth in said sections.

7. The foot-operated tire changing mechanism defined in claim 6 further including a reversing mechanism connected to said connection assembly second coupling element.

8. The foot-operated tire changing mechanism defined in claim 7 wherein said reversing mechanism includes a gear connected to said connection assembly shaft, a first intermediate gear that is engaged with said reversing mechanism first intermediate gear, a second intermediate gear that is movable into and out of connection with said first intermediate gear, an output gear that is movable into direct connection with said first intermediate gear and into direct connection with said second intermediate gear.

9. The foot-operated tire changing mechanism defined in claim 8 further including a rotation transferring assembly which is connected to said connection assembly and which includes two sets of bevel gears connected to each other by a shaft, an input coupling which is coupled to said foot pedal assembly shaft and an output coupling.

10. The foot-operated tire changing mechanism defined in claim 9 further including an elevating means connected to said connection assembly.

11. The foot-operated tire changing mechanism defined in claim 10 wherein said elevating means includes a jack screw device.

12. The foot-operated tire changing mechanism defined in claim 11 further including non-skid means on said foot pedal assembly foot-engaging element.

13. The foot-operated tire changing mechanism defined in claim 12 wherein said connection assembly second coupling element is adapted to couple a tire lug nut to said connection assembly shaft.

14. The foot-operated tire changing mechanism defined in claim 13 wherein said connection assembly slot is oriented vertically.

* * * * *